US008944645B2

(12) United States Patent
Wei

(10) Patent No.: US 8,944,645 B2
(45) Date of Patent: Feb. 3, 2015

(54) LIGHT FIXTURE

(71) Applicant: Lextar Electronics Corporation, Hsinchu (TW)

(72) Inventor: Kuo-Chung Wei, Xinpu Township (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 14/011,403

(22) Filed: Aug. 27, 2013

(65) Prior Publication Data

US 2014/0104828 A1 Apr. 17, 2014

(30) Foreign Application Priority Data

Oct. 12, 2012 (TW) ..... 101137750 A

(51) Int. Cl.
*F21V 19/00* (2006.01)

(52) U.S. Cl.
CPC ..... *F21V 19/0005* (2013.01); *F21V 19/008* (2013.01)
USPC ..... 362/311.02; 362/217.02; 362/219

(58) Field of Classification Search
USPC ..... 362/225, 217.02, 221, 219, 249.02, 362/311.02
See application file for complete search history.

(56) References Cited

U.S. PATENT DOCUMENTS

| | | | | |
|---|---|---|---|---|
| 7,722,223 | B2 * | 5/2010 | Saito et al. | 362/311.06 |
| 2002/0114155 | A1 * | 8/2002 | Katogi et al. | 362/219 |
| 2009/0290334 | A1 * | 11/2009 | Ivey et al. | 362/219 |
| 2011/0085335 | A1 * | 4/2011 | Osawa | 362/249.14 |
| 2011/0273631 | A1 * | 11/2011 | Hayashi | 348/790 |

FOREIGN PATENT DOCUMENTS

| | | |
|---|---|---|
| TW | M349465 | 1/2009 |
| TW | 201013101 A | 4/2010 |
| TW | M399281 | 9/2010 |
| TW | M425230 | 9/2011 |

* cited by examiner

*Primary Examiner* — Laura Tso
(74) *Attorney, Agent, or Firm* — Moser Taboada

(57) ABSTRACT

A light fixture includes a light guide member, a light bar, and two conductive pins. A cavity is formed on a bottom portion of the light guide member, and two engaging groove are respectively at two sides of the bottom portion. The light bar is arranged under the bottom portion of the light guide member, and a plurality of light emitting units are disposed on a surface of the light bar. Two sides of the light bar are respectively fixed in the two engaging grooves, such that the emitting units are located in the cavity. The two conductive pins protrude from each end of the light guide member, and are electrically connected to the light emitting units.

15 Claims, 8 Drawing Sheets

LIGHT FIXTURE

RELATED APPLICATIONS

This application claims priority to Taiwan Application Serial Number 101137750, filed Oct. 12, 2012, which is herein incorporated by reference.

BACKGROUND

1. Technical Field

The present disclosure relates to a light fixture.

2. Description of Related Art

A conventional light tube using light emitting diodes (LEDs) as a light source typically has a tube, end caps, and a light bar located in the tube. LEDs and conductive contacts are arranged on a surface of the light bar. The end caps are fixed to two ends of the tube, and conductive pins are configured on the end caps and are electrically connected to the conductive contacts of the light bar. The conductive pins can be connected to an external power supply to receive power for the LEDs of the light bar. Generally, the conductive pins are connected to the conductive contacts of the light bar by conductive wires. Two ends of one of the conductive wires may be respectively soldered on one of the conductive pins and one of the conductive contacts of the light bar. However, defective soldering associated with the conductive wires is a common problem, such that the conductive wires are easily separated from the conductive pins and contacts when subjected to an external force. Therefore, the yield rate of the tube is difficult to improve. Furthermore, since the end caps are fixed to two ends of the tube, heat generated by the light bar is not easily dissipated, and additional heat dissipation elements need to be used in the tube.

For the manufacturer of the tube, the end caps, the conductive wires and the heat dissipation elements not only increase the material costs associated with manufacturing the tube, but also increase the labor costs since much time is needed to assemble the light tube. Moreover, since the light bar is fixed in the tube and the end caps, the light bar cannot be easily replaced with another light bar having a different illumination and color temperature, resulting in inconvenience when users desire to change the light bar.

SUMMARY

An aspect of the present invention is to provide a light fixture.

In an embodiment of the present invention, a light fixture includes a light guide member, a light bar, and two conductive pins. A cavity is formed on a bottom portion of the light guide member, and two engaging groove are respectively at two sides of the bottom portion. The light bar is arranged under the bottom portion of the light guide member, and a plurality of light emitting units are disposed on a surface of the light bar. Two sides of the light bar are respectively fixed in the two engaging grooves, such that the emitting units are located in the cavity. The two conductive pins protrude from each end of the light guide member, and are electrically connected to the light emitting units.

In an embodiment of the present invention, axes of the cavity and the two engaging grooves are parallel with each other.

In an embodiment of the present invention, the light guide member has a light incident surface and a light output surface opposite to the light incident surface, and the light incident surface is located in the cavity and faces the light emitting units.

In an embodiment of the present invention, the light bar is slidably engaged with the two engaging grooves of the bottom portion of the light guide member, such that the light bar is assembled and fixed under the bottom portion of the light guide member by sliding along the two engaging grooves of the bottom portion of the light guide member.

In an embodiment of the present invention, the light guide member has a side surface connected to an edge of the light output surface and an edge of the light incident surface at the same side of the light guide member, and the side surface has two holes each for receiving a portion of one of the two conductive pins.

In an embodiment of the present invention, the light fixture further includes two O-rings. The two O-rings are respectively located in the two holes and respectively sleeved on the two conductive pins.

In an embodiment of the present invention, the bottom portion of the light guide member has two accommodating holes. The light bar has two conductive pads respectively aligned with the two accommodating holes. The light fixture further includes two flexible conductive rods. The two flexible conductive rods are respectively received in the two accommodating holes. Two ends of each of the two flexible conductive rods are abutted against the corresponding conductive pad and conductive pin.

In an embodiment of the present invention, the two accommodating holes for receiving the flexible conductive rods are respectively communicated with the two holes for receiving the conductive pins.

In an embodiment of the present invention, each of the two flexible conductive rods includes a sleeve, a spring, and two flexible portions. The spring is located in the sleeve. The two flexible portions are respectively located at two ends of the sleeve and connected to the spring.

In an embodiment of the present invention, the sleeve has a baffle board, and the two flexible portions are located on two opposite sides of the baffle board.

In an embodiment of the present invention, each of the two conductive pins has a positioning cavity formed therein. An end of each of the two flexible conductive rods is received in the corresponding positioning cavity.

In an embodiment of the present invention, a longitudinal direction of each of the two flexible conductive rods is perpendicular to a longitudinal direction of the light bar.

In an embodiment of the present invention, a longitudinal direction of each of the two flexible conductive rods is perpendicular to a longitudinal direction of one of the conductive pins.

In an embodiment of the present invention, the light emitting units include light emitting diodes.

In an embodiment of the present invention, the light guide member is made of a material that includes glass, plastic, or acrylic.

In the aforementioned embodiments of the present invention, since the cavity is formed on the bottom portion of the light guide member, and the engaging groove is formed on each of the two sides of the bottom portion, the two sides of the light bar can be respectively fixed in the two engaging grooves. When the two sides of the light bar are respectively fixed in the two engaging grooves, the light emitting units are located in the cavity of the light guide member. When the light emitting units of the light bar emit light, the light can pass through the light guide member. During this operation, air can flow through the cavity, thereby reducing the temperature of the light emitting units. Conventional end caps, conductive wires, and heat dissipation elements can be omitted from the configuration of the light fixture, thereby making assembly of the light fixture easy, and reducing the material and labor costs of the light fixture. Moreover, since the light bar is located in the two engaging grooves, the light bar can be easily replaced by another light bar having a different illumination and color temperature, such that the usability of the light fixture is improved.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
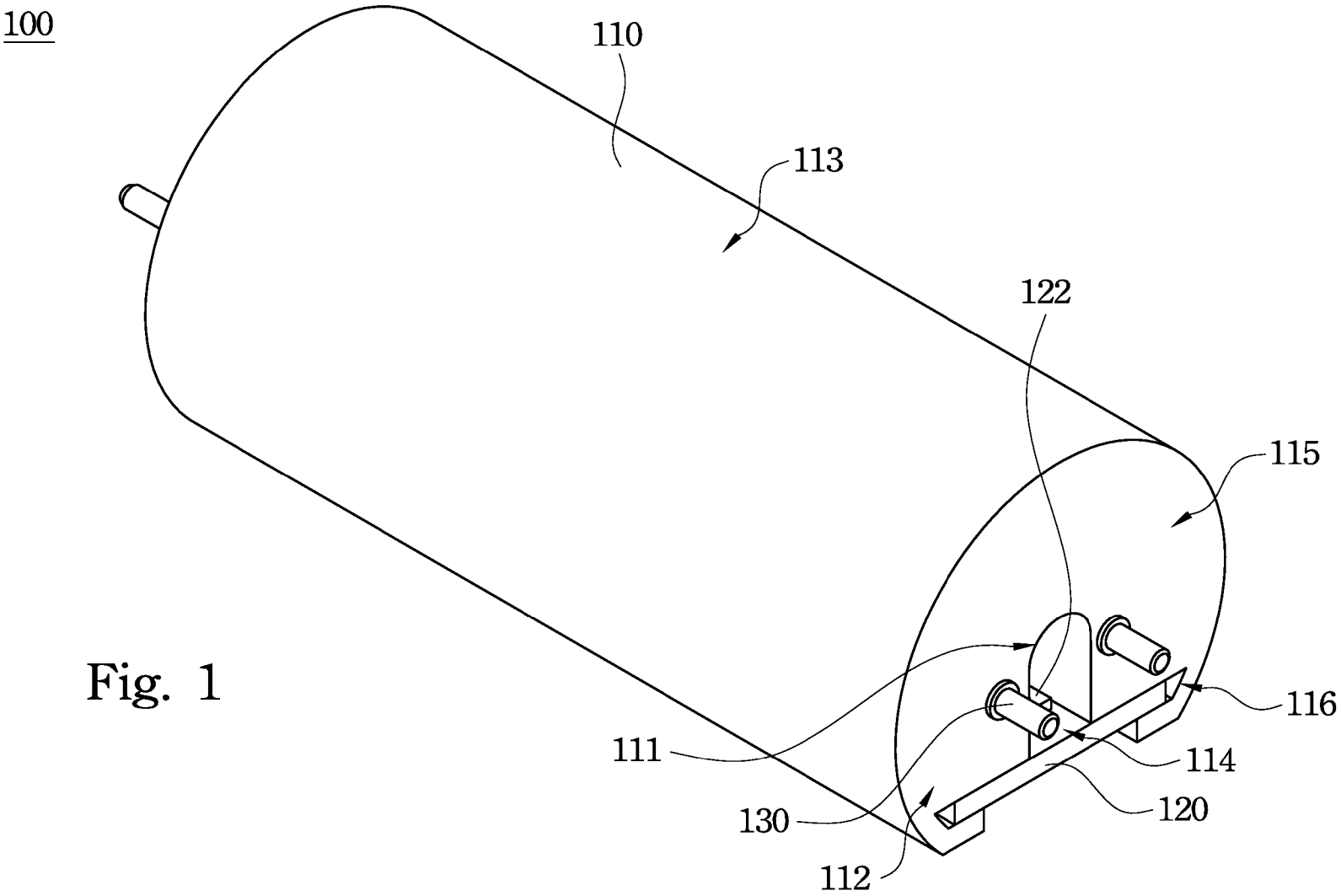
FIG. 1 is a perspective view of a light fixture according to an embodiment of the present invention.
Figure 2:
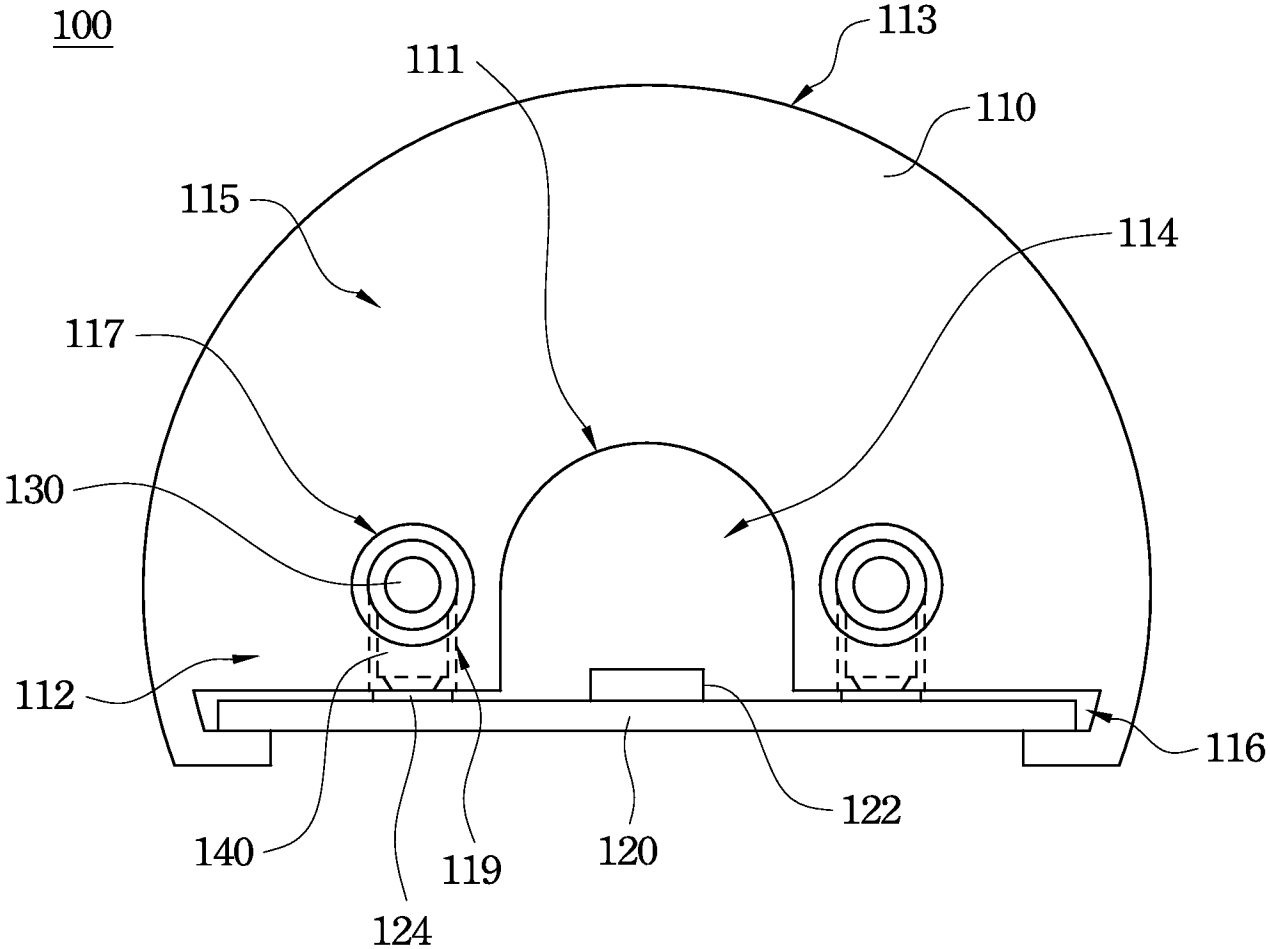
FIG. 2 is a side view of the light fixture shown in FIG. 1, in which the side view is from a side surface of the light fixture.

FIG. 1 is a perspective view of a light fixture 100 according to an embodiment of the present invention. FIG. 2 is a side view of the light fixture 100 shown in FIG. 1, in which the side view is from a side surface 115 of the light fixture 100. As shown in FIG. 1 and FIG. 2, the light fixture 100 includes a light guide member 110, a light bar 120, and two conductive pins 130. The light guide member 110 is elongate and has two ends. A cavity 114 is formed on a bottom portion 112 of the light guide member 110 and is substantially located at a center position of the light guide member 110. Two engaging groove 116 are respectively at two sides of the bottom portion 112. A plurality of light emitting units 122 (see FIG. 5) are disposed on a surface of the light bar 120, and the light bar 120 is arranged under the bottom portion 112 of the light guide member 110. The two conductive pins 130 protrude from each of the two ends of the light guide member 110, and are electrically connected to the light emitting units 122. Furthermore, two sides of the light bar 120 are respectively disposed in the two engaging grooves 116. The light bar 120 is fixed in the two engaging grooves 116 through the friction force between the light bar 120 and the two engaging grooves 116. Moreover, when an external force is applied to the light bar 120, the light bar 120 can move in the two engaging grooves 116. That is to say, the light bar 120 is assembled and fixed to the bottom portion 112 of the light guide member 110 by sliding the light bar 120 along the two engaging grooves 116 of the bottom portion 112 of the light guide member 110. In this embodiment, the length of the light guide member 110 and the length of the light bar 120 are substantially the same, but in another embodiment, the length of the light guide member 110 may be greater than the length of the light bar 120, and the present invention is not limited in this regard.

When the light bar 120 is assembled to the light guide member 110, the emitting units 122 on the light bar 120 are located in the cavity 114. The light guide member 110 has a light incident surface 111 and a light output surface 113 opposite to the light incident surface 111. The light incident surface 111 is located in the cavity 114 and faces the light emitting units 122. When the light emitting units 122 emit light, the light enters into the light guide member 110 through light incident surface 111 and emits from the light guide member 110 through the light output surface 113. Moreover, each of the ends of the light guide member 110 has the side surface 115, which is connected to an edge of the light output surface 113 and an edge of the light incident surface 111 at the same side of the light guide member 110, and the side surface 115 has two holes 117 for respectively receiving the two conductive pins 130. In use, the two conductive pins 130 may be respectively electrically connected to an anode and a cathode of a power source, such that power is supplied to the light emitting units 122 to enable the same to emit light.

In this embodiment, the light guide member 110 may be made of a material that includes glass, plastic, or acrylic. The conductive pins 130 may be made of a material that includes metal, such as a conductive material, gold, silver, copper, iron, or combinations thereof, but the present invention is not limited to the aforementioned materials. Moreover, the number of the light emitting units 122 and the number of the conductive pins 130 can be designed as needed for the particular intended application, and the present invention is not limited in this regard. It is necessary only that that the light fixture 100 has at least two conductive pins 130 to electrically connect to the anode and cathode of a power source. Each of the light emitting units 122 may be a light emitting diode, or another lighting element (e.g., a light bulb).

Figure 3:
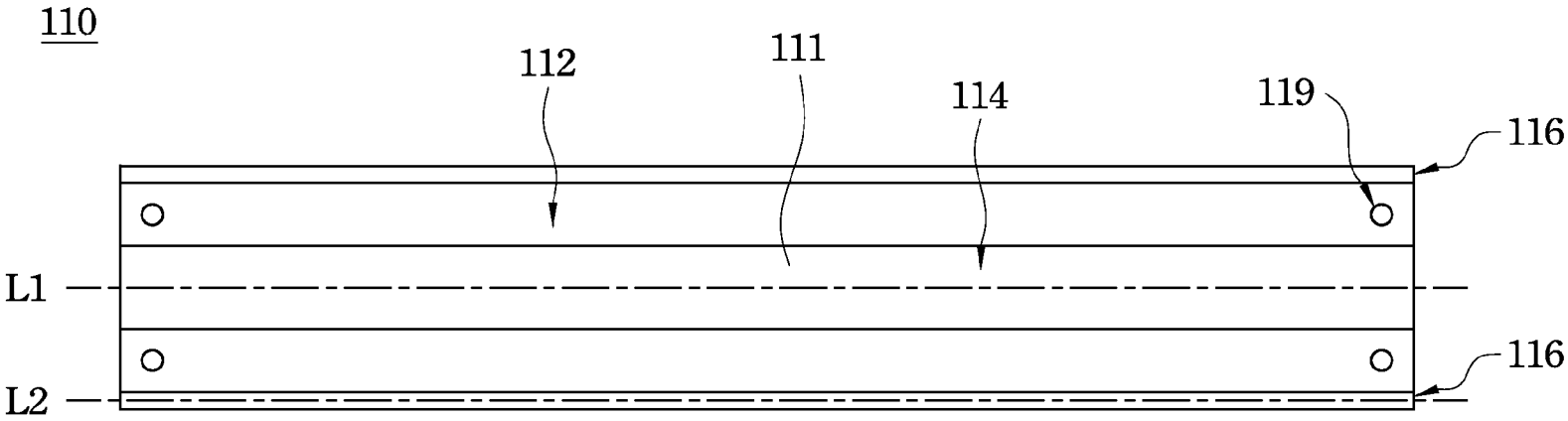
FIG. 3 is a bottom view of a light guide member shown in FIG. 1.
Figure 5:
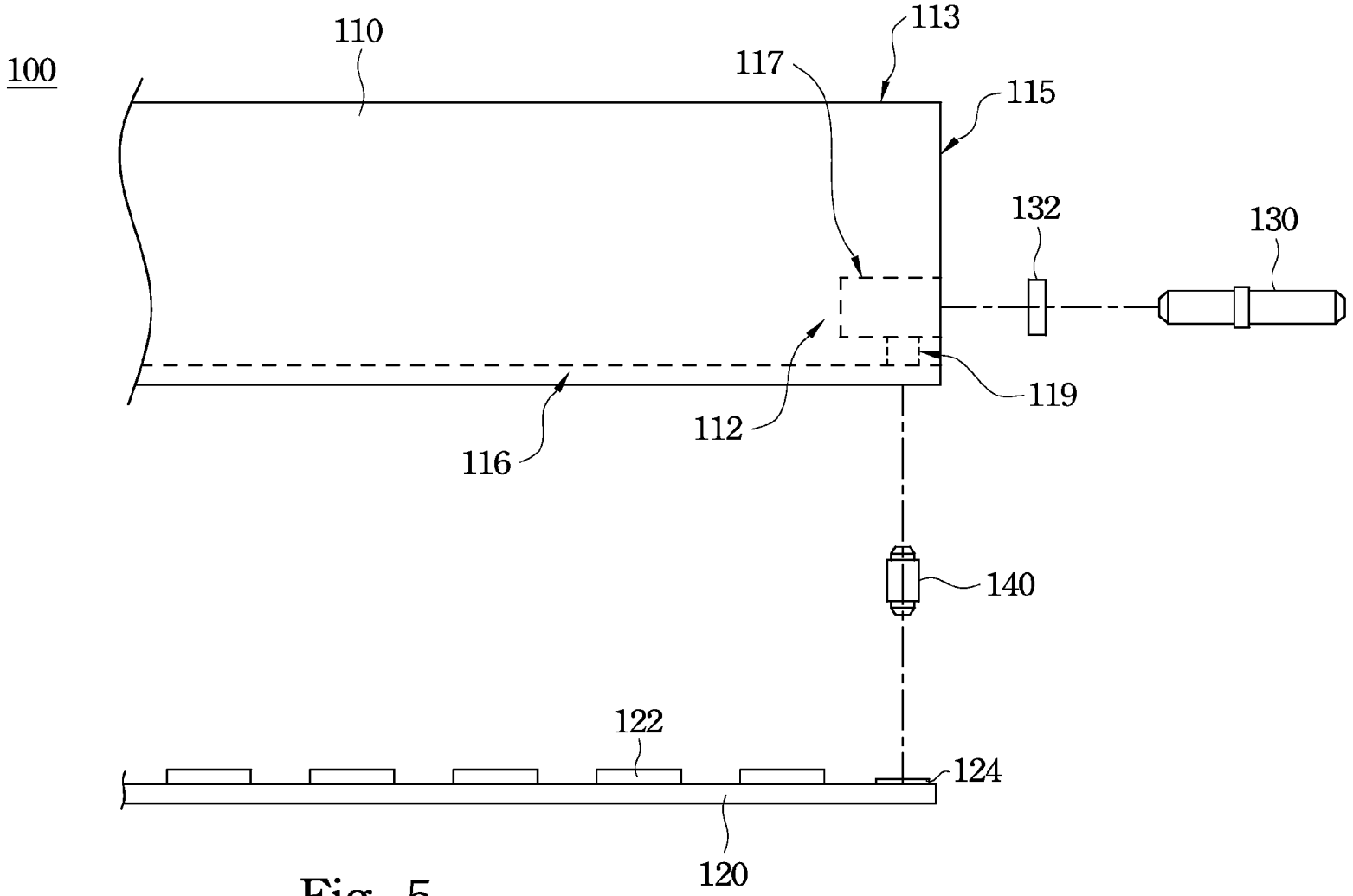
FIG. 5 is a partial exploded side view of the light fixture shown in FIG. 1 along a longitudinal side of the light fixture.

FIG. 3 is a bottom view of the light guide member 110 shown in FIG. 1. As shown in FIG. 2 and FIG. 3, the bottom portion 112 of the light guide member 110 has a plurality of accommodating holes 119. The light bar 120 has a plurality of conductive pads 124. When the light bar 120 is assembled to the light guide member 110, the conductive pads 124 are respectively aligned with the accommodating holes 119, as shown in FIG. 5.

Moreover, the light fixture 100 may further include a plurality of flexible conductive rods 140. The flexible conductive rods 140 can be respectively disposed in the accommodating holes 119, and two ends of each of the flexible conductive rods 140 are abutted against the corresponding conductive pad 124 and conductive pin 130. As a result, when the conductive pins 130 receive a current from an external power source, the current can be transferred to the conductive pads 124 of the light fixture 100 and next transferred to a circuit (not shown) of the light bar 120, thereby resulting in the operation of the light emitting units 122.

In this embodiment, a longitudinal axis L1 of the cavity 114 of the light guide member 110 is parallel to a longitudinal axis L2 of each of the engaging grooves 116 (only one is indicated in FIG. 3). Since the surface of the cavity 114 is the light incident surface 111, an extending direction of the light incident surface 111 is the same as an extending direction of the engaging grooves 116. Therefore, when the two sides of the light bar 120 are respectively fixed in the two engaging grooves 116, the light emitting units 122 of the light bar 120 can all face the light incident surface 111.

Assembly of the light fixture 100 will now be described.

Figure 4:
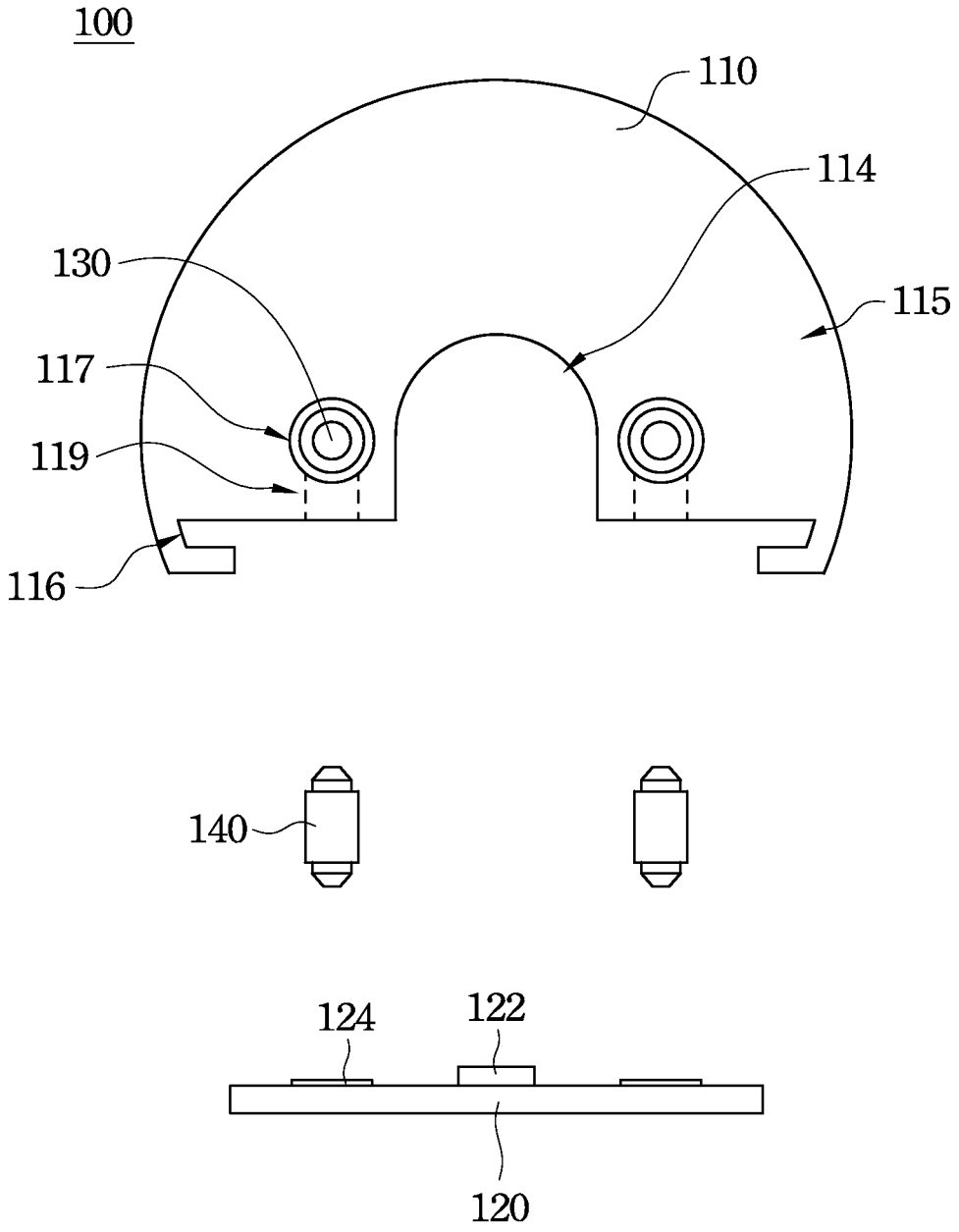
FIG. 4 is an exploded view of the light fixture shown in FIG. 2.

FIG. 4 is an exploded view of the light fixture 100 shown in FIG. 2. FIG. 5 is a partial exploded side view of the light fixture 100 shown in FIG. 1 along a longitudinal side of the light fixture 100. As shown in FIG. 4 and FIG. 5, each of the accommodating holes 119 is respectively communicated with the corresponding hole 117. The light fixture 100 may further include a plurality of O-rings 132. During assembly, the O-rings 132 can be placed in the holes 117, respectively. Next, each of the conductive pins 130 can be inserted in one of the holes 117, such that the corresponding O-ring 132 is sleeved on the conductive pin 130 and positioned in the hole 117. Finally, the flexible conductive rods 140 can be inserted in the accommodating holes 119, respectively. At this time, the flexible conductive rods 140 can be abutted respectively against the conductive pins 130.

After the flexible conductive rods 140 are inserted in the accommodating holes 119, ends of the flexible conductive rods 140 that are not abutted against the conductive pins 130 protrude from the accommodating holes 119. In this state, one side of the light bar 120 can be obliquely engaged in one of the engaging grooves 116, after which the other side of the light bar 120 can be engaged in the other engaging groove 116. The assembly of the light bar 120 in this manner is similar to the way in which a window is engaged to top and bottom slide rails. Since the flexible conductive rods 140 are flexible (the structure thereof will be described hereinafter), when the light bar 120 is assembled to the light guide member 110, the flexible conductive rods 140 do not impede the light bar 120, and two ends of each of the flexible conductive rods 140 can be respectively abutted against the corresponding conductive pin 130 and the corresponding conductive pad 124 of the light bar 120.

However, the assembly of the light bar 120 is not limited in this regard. For example, the light bar 120 can be inserted between the two engaging grooves 116 from an end of the two engaging grooves 116 adjacent to the side surface 115. Furthermore, the aforementioned assembly sequence may be adjusted in accordance with practical requirements. For instance, the O-rings 132 may be sleeved on the conductive pins 130 first. Next, the conductive pins 130 and the O-rings 132 may be inserted together in the holes 117.

When the two sides of the light bar 120 are respectively fixed in the two engaging grooves 116, the light emitting units 122 are located in the cavity 114 of the light guide member 110, and the side surface 115 of the light guide member 110 is not covered by an end cap to thereby expose the cavity 114. When the light emitting units 122 emit light, the light can pass through the light guide member 110. During operation, air can flow through the cavity 114, thereby improving the heat dissipation of the light emitting units 122 to reduce the temperature of the same. Conventional end caps, conductive wires, and heat dissipation elements can be omitted from the configuration of the light fixture 100, thereby making assembly of the light fixture 100 is easy, and reducing the material and labor costs of the light fixture 100. Moreover, since the light bar 120 is detachably located in the two engaging grooves 116, the light bar 120 can be easily replaced by another light bar 120 having a different illumination and color temperature, such that the usability of the light fixture 100 is improved.

Figure 6:
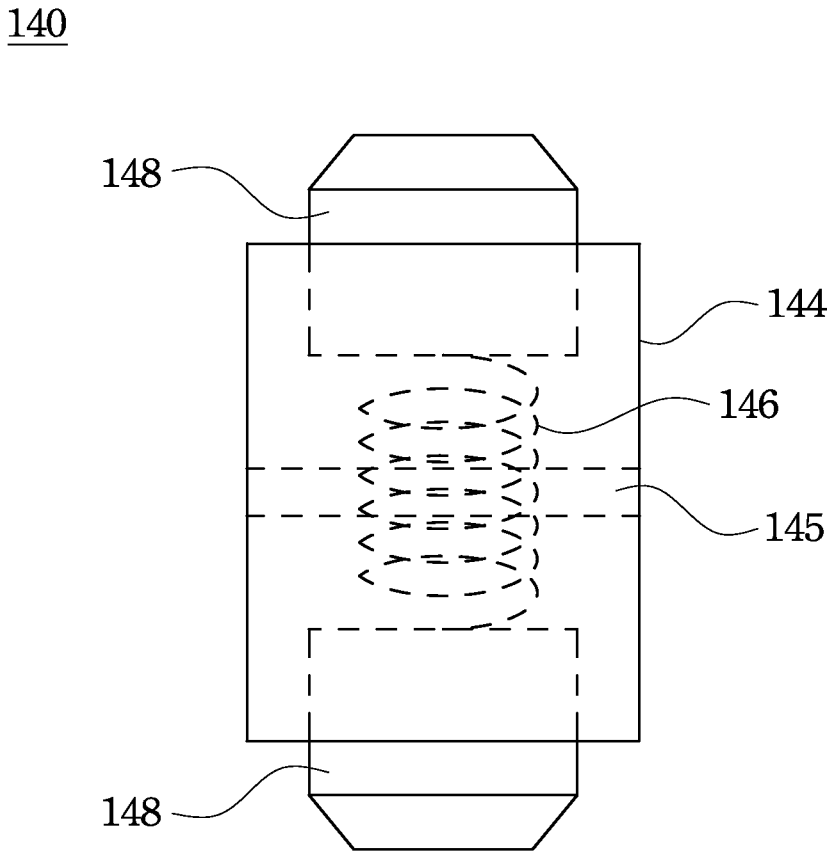
FIG. 6 is a schematic side view of a flexible conductive rod shown in FIG. 4.

FIG. 6 is a schematic side view of one of the flexible conductive rods 140 shown in FIG. 4. As shown in FIG. 6, the flexible conductive rod 140 includes a sleeve 144, a spring 146, and two flexible portions 148. The spring 146 is located in the sleeve 144. The two flexible portions 148 are respectively located at two ends of the sleeve 144 and connected to the spring 146. Moreover, the sleeve 144 has a baffle board 145, and the two flexible portions 148 are respectively located on two opposite sides of the baffle board 145. In this embodiment, the single spring 146 passes through the baffle board 145 and is fixed to the baffle board 145. When the two flexible portions 148 are not compressed, the two flexible portions 148 can protrude from the sleeve 144. When the two flexible portions 148 are compressed, the two flexible portions 148 can be disposed within the sleeve 144. In another embodiment, two springs can be arranged between the two flexible portions 148 and the baffle board 145.

Figure 7:
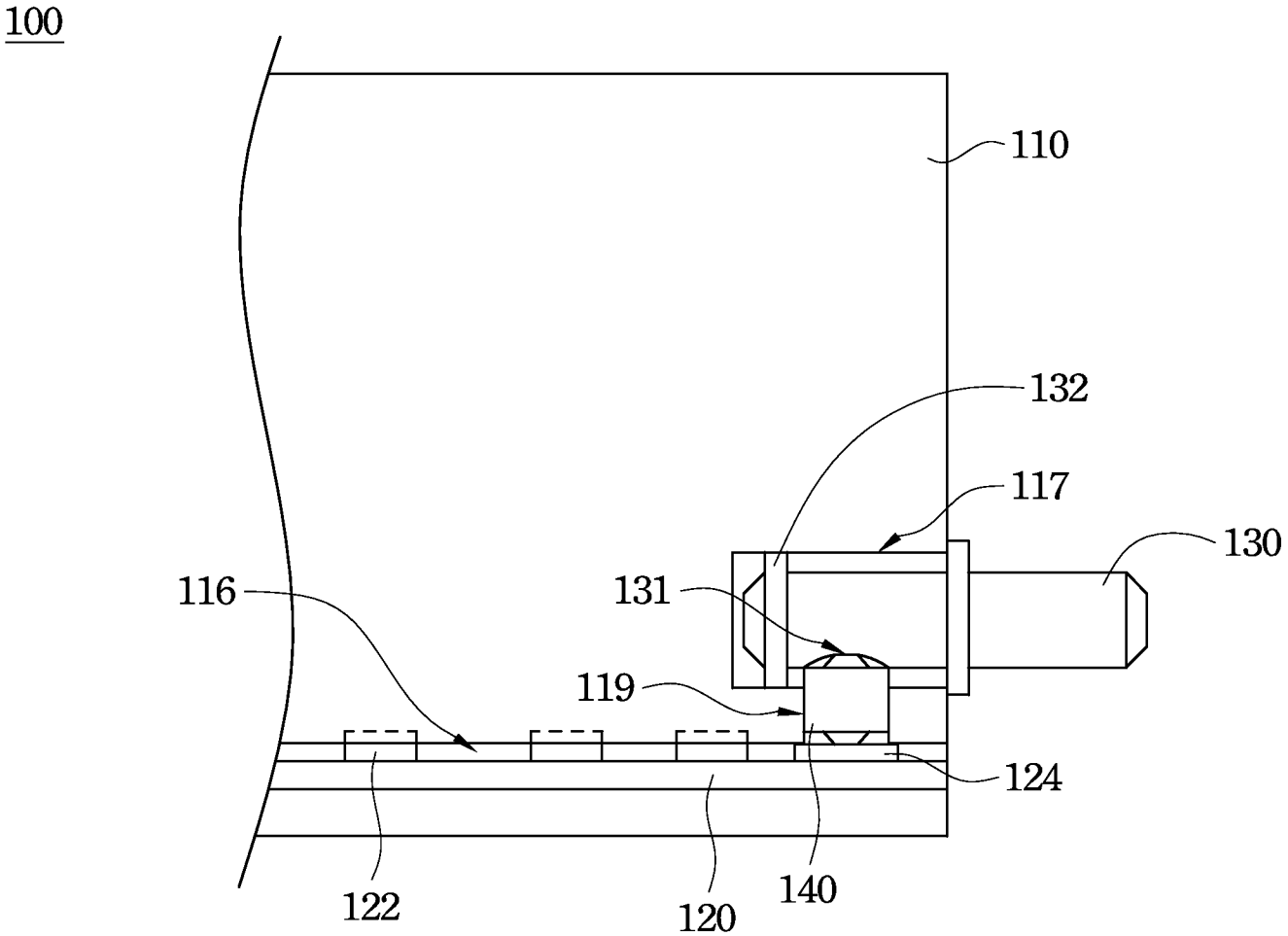
FIG. 7 is a partial side view of the light fixture shown in FIG. 5 after being assembled.

FIG. 7 is a partial side view of the light fixture 100 shown in FIG. 5 after being assembled. To simplify the explanation to follow, only one of the conductive pins 130, one of the flexible conductive rods 140, and the structure corresponding thereto as shown in FIG. 7 will be described. However, it is noted that a plurality of each of these elements may be included in the configuration of the light fixture 100, as described above. As shown in FIG. 7, the conductive pin 130 has a positioning cavity 131 formed therein. The flexible conductive rod 140 is compressed by the light bar 120, such that two ends of the flexible conductive rod 140 can be respectively received in the positioning cavity 131 and abutted against the conductive pad 124 of the light bar 120. The flexible conductive rod 140 can be firmly located between the conductive pin 130 and the light bar 120 as a result of the formation of the positioning cavity 131 of the conductive pin 130. Moreover, the positioning cavity 131 reduces the contact resistance between the conductive pin 130 and the flexible conductive rod 140. Furthermore, the O-ring 132 is located in the hole 117 and sleeved on the conductive pin 130. The material of the O-ring 132 may include rubber. The O-ring 132 not only can position the conductive pin 130 in the hole 117, but when the conductive pin 130 is under an external force to move, the O-ring 132 functions to buffer the force applying on the light guide member 110.

In this embodiment, a longitudinal direction of the flexible conductive rod 140 is perpendicular to longitudinal directions of the light bar 120 and the conductive pin 130, but the present invention is not limited in this regard. For example, an included angle from 85 to 95 degrees may be formed between the flexible conductive rod 140 and the light bar 120, or between the flexible conductive rod 140 and the conductive pin 130.

Figure 8:
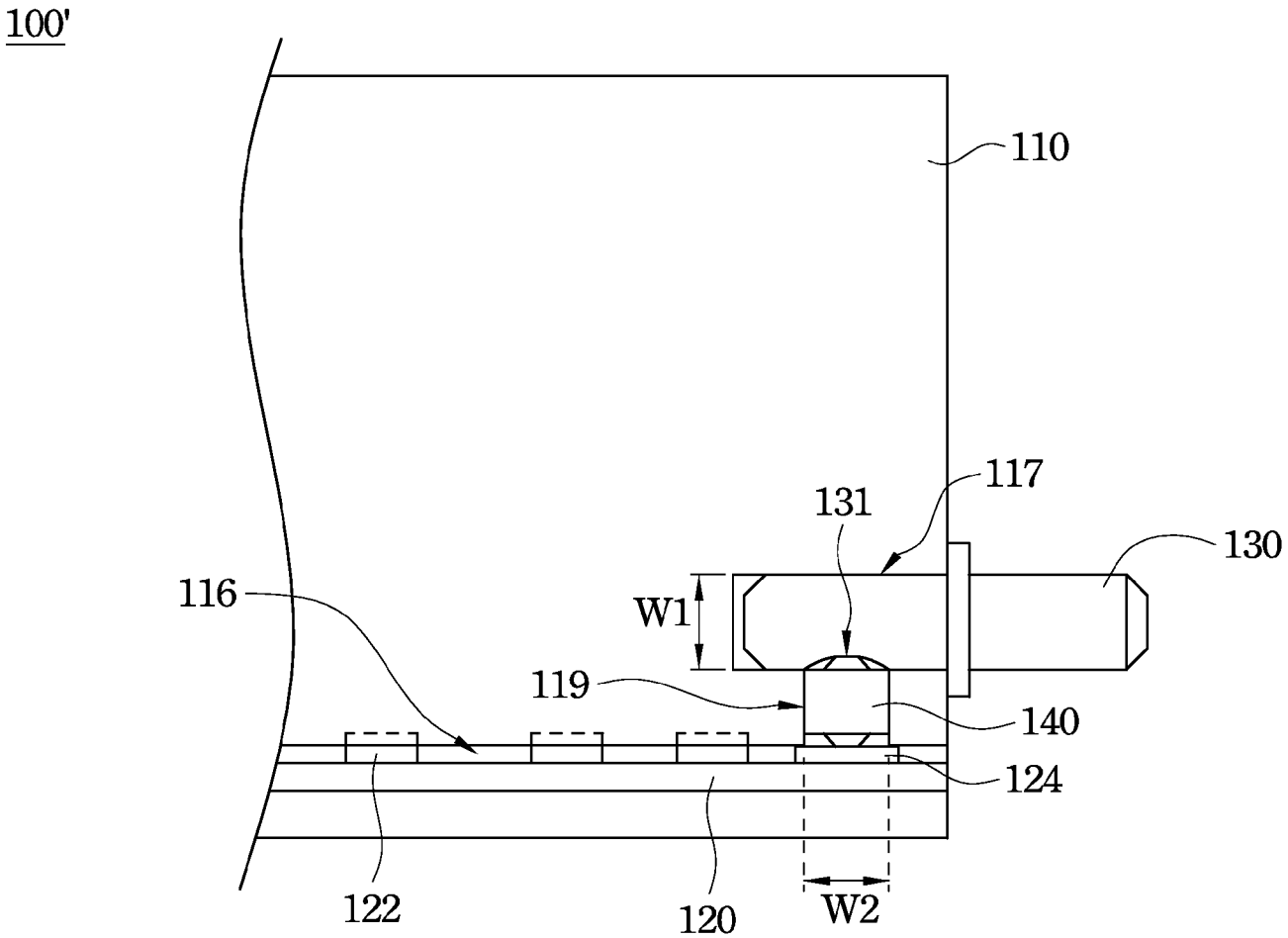
FIG. 8 is a partial side view of a light fixture according to an embodiment of the present invention.

FIG. 8 is a partial side view of a light fixture 100' according to an embodiment of the present invention. As in the case of the above embodiment, also in this embodiment, to simplify the explanation to follow, only one of the conductive pins 130, one of the flexible conductive rods 140, and the structure corresponding thereto as shown in FIG. 8 will be described. However, it is noted that a plurality of each of these elements may be included in the configuration of the light fixture 100'. The light fixture 100' includes the light guide member 110, the light bar 120, and the conductive pin 130. The difference between this embodiment and the embodiment shown in FIG. 7 is that the O-ring 132 is not sleeved on the conductive pin 130. In this embodiment, a diameter W1 of the hole 117 is substantially the same as the diameter of the conductive pin 130, and a diameter W2 of the accommodating hole 119 is substantially the same as the diameter of the flexible conductive rod 140. As a result, although the light fixture 100' does not have the O-ring 132, the conductive pin 130 and the flexible conductive rod 140 can be respectively firmly positioned in the hole 117 and the accommodating hole 119.

Compared with a conventional tube, since the cavity is formed on the bottom portion of the light guide member, and the engaging groove is formed on each of the two sides of the bottom portion, the two sides of the light bar can be respectively fixed in the two engaging grooves. When the two sides of the light bar are respectively fixed in the two engaging grooves, the light emitting units of the light bar are located in the cavity of the light guide member. When the light emitting units emit light, the light can pass through the light guide member. During this operation, air can flow through the cavity, thereby reducing the temperature of the light emitting units. Conventional end caps, conductive wires, and heat dissipation elements can be omitted from the configuration of the light fixture, thereby making assembly of the light fixture is easy, and reducing the material and labor costs of the light fixture. Moreover, since the light bar is located in the two engaging grooves, the light bar can be easily replaced by another light bar having a different illumination and color temperature, such that the usability of the light fixture is improved.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A light fixture comprising:

a light guide member, wherein a cavity is formed on a bottom portion of the light guide member, and two engaging grooves are respectively at two sides of the bottom portion;

a light bar arranged under the bottom portion of the light guide member, wherein a plurality of light emitting units are disposed on a surface of the light bar, and two sides of the light bar are respectively fixed in the two engaging grooves, such that the light emitting units are located in the cavity; and two conductive pins protruding from each end of the light guide member and electrically connected to the light emitting units.

2. The light fixture as claimed in claim 1, wherein axes of the cavity and the two engaging grooves are parallel with each other.

3. The light fixture as claimed in claim 2, wherein the light guide member has a light incident surface and a light output surface opposite to the light incident surface, and the light incident surface is located in the cavity and faces the light emitting units.

4. The light fixture as claimed in claim 3, wherein the light bar is slidably engaged with the two engaging grooves of the bottom portion of the light guide member, such that the light bar is assembled and fixed under the bottom portion of the light guide member by sliding along the two engaging grooves of the bottom portion of the light guide member.

5. The light fixture as claimed in claim 4, wherein each of the ends of the light guide member has a side surface which is connected to an edge of the light output surface and an edge of the light incident surface, and the side surface has two holes for receiving the two conductive pins respectively.

6. The light fixture as claimed in claim 5, further comprising:

two O-rings respectively located in the two holes and respectively sleeved on the two conductive pins.

7. The light fixture as claimed in claim 6, wherein the bottom portion of the light guide member has two accommodating holes, the light bar has two conductive pads respectively aligned with the two accommodating holes, and the light fixture further comprises:

two flexible conductive rods respectively received in the two accommodating holes, wherein two ends of each of the two flexible conductive rods are abutted against the corresponding conductive pad and conductive pin.

8. The light fixture as claimed in claim 7, wherein the two accommodating holes for receiving the flexible conductive rods are respectively communicated with the two holes for receiving the conductive pins.

9. The light fixture as claimed in claim 7, wherein each of the two flexible conductive rods comprises:

a sleeve;

a spring located in the sleeve; and two flexible portions respectively located at two ends of the sleeve and connected to the spring.

10. The light fixture as claimed in claim 9, wherein the sleeve has a baffle board, and the two flexible portions are respectively located on two opposite sides of the baffle board.

11. The light fixture as claimed in claim 7, wherein each of the two conductive pins has a positioning cavity formed therein, and an end of each of the two flexible conductive rods is received in the corresponding positioning cavity.

12. The light fixture as claimed in claim 7, wherein a longitudinal direction of each of the two flexible conductive rods is perpendicular to a longitudinal direction of the light bar.

13. The light fixture as claimed in claim 7, wherein a longitudinal direction of each of the two flexible conductive rods is perpendicular to a longitudinal direction of one of the conductive pins.

14. The light fixture as claimed in claim 1, wherein the light emitting units comprise light emitting diodes.

15. The light fixture as claimed in claim 14, wherein the light guide member is made of a material that comprises glass, plastic, or acrylic.

* * * * *